United States Patent [19]

Beno

[11] 4,078,217

[45] Mar. 7, 1978

[54] MICROWAVE ISOLATION SWITCH

[75] Inventor: Lawrence A. Beno, Camarillo, Calif.

[73] Assignee: The United States of America as represented by the Secretary of the Navy, Washington, D.C.

[21] Appl. No.: 734,899

[22] Filed: Oct. 22, 1976

Related U.S. Application Data

[62] Division of Ser. No. 673,557, Apr. 5, 1976, Pat. No. 4,031,488.

[51] Int. Cl.[2] ..... H01P 1/10

[52] U.S. Cl. ..... 333/97 S; 333/84 M

[58] Field of Search ..... 333/7 D, 97 S, 98 S, 333/81 R, 81 A, 81 B

[56] References Cited

U.S. PATENT DOCUMENTS

| | | | |
|---|---|---|---|
| 3,164,792 | 1/1965 | Georgiev et al. | 333/98 S UX |
| 3,245,014 | 4/1966 | Plutchok et al. | 333/97 S |
| 3,959,750 | 5/1976 | Holt | 333/97 S |

*Primary Examiner*—Paul L. Gensler
*Attorney, Agent, or Firm*—Richard S. Sciascia; Joseph M. St.Amand; Darrell E. Hollis

[57] ABSTRACT

A microwave isolation switch comprising a D.C. bias source and a diode network for passing a microwave signal from an input port to an output port when the D.C. bias source is in a negative mode of operation and for reflecting and terminating the microwave signal when the D.C. bias source is in a positive mode of operation.

10 Claims, 1 Drawing Figure

MICROWAVE ISOLATION SWITCH

This is a division of application Ser. No. 673,557 filed Apr. 5, 1976 now U.S. Pat. No. 4,031,488 issued June 21, 1977.

BACKGROUND OF THE INVENTION

1. Field of the Invention

The present invention relates generally to microwave isolation switches and more particularly to such microwave isolation switches utilizing strip transmission lines.

2. Description of the Prior Art

Many radar systems are designed to operate either in a linear polarization mode or a circular polarization mode. While the normal mode of operation is the linear mode under some weather conditions such as heavy rain there is considerable advantage in using circular polarization. This results from the fact that rain drops which are spherical reflects circularly polarized waves back as circularly polarized waves that are polarized in the opposite sense whereas most targets are non-spherical and reflect but a portion of the circularly polarized transmitted waves. The reflected portion being elliptically or linearly polarized.

In addition to having a selection of polarization modes for weather condition the plurality of modes are also useful in combat operations as the radar is less susceptible to jamming. It has been proven in actual flight tests that anti-jamming performance can be enhanced by being able to change to a left-hand circular polarization as well as the commonly used right-hand circular and vertical linear polarizations.

In one heretofore known device for selectively switching modes a quarter-wave plate is rotatably mounted within a feed horn that can be rotated in a clockwise or counter-clockwise direction. With the feed horn being rotated in a counter-clockwise direction friction between the outer race of a bearing mounting of quarter-wave plate and the inner race causes the quarter-wave plate to be rotated until its housing is stopped by a mechanical stop. In this position which is referred to as the left-hand circular mode, the quarter-wave plate is positioned diagonally at approximately 45° to the vertical axis of the feed horn. In order to change to a right-hand circular mode, it is merely necessary to change the direction of the rotation of the feed horn. With the feed horn rotating in a clockwise direction the quarter-wave plate will be rotated 90 degrees until its housing encounters a second mechanical stop. This position is referred to as the right-hand circular mode. In order to change from a left-hand circular mode to a linear polarization mode, an electromagnet is energized which in turn causes a third stop to be pivoted into position such that it will permit the quarter-wave plate to rotate only 45°. The direction of rotation of the feed horn is then changed to a clockwise direction and the quarter-wave plate is rotated in that direction until its housing is stopped by the third mechanical stop that was previously pivoted into position.

In one heretofore known device for selectively switching mode, an antenna feed horn is continuously rotated in one direction and each of three polarizations, i.e., left-hand circular, right-hand circular or linear, can be selected by energizing certain electromagnets. A quarter-wave plate is mounted within a housing that is provided with three catch surfaces, with the housing being rotatably mounted with respect to a rotating feed horn. Three separate levers, which are actuated by electromagnets, are pivotally mounted in a stationary ring within the feed horn and by selectively energizing the electromagnets various levers can be made to engage various catch surfaces. When no lever is engaged with any catch surface, the housing, and consequently the quarter-wave plate, is rotated due to the friction of the bearing that mounts the housing to the rotating feed horn.

While the above described methods of changing polarizations do work satisfactorily there are several inherent disadvantages in these methods of polarization selection. First, the time lag involved in reversing feed horn motor could cause the radar to lose its lock-on status. Also errors result in the positioning of the reference generator when the direction of the feed horn is reversed since the generator is nulled for either clockwise or counter-clockwise rotation. In addition, such polarization devices are custom designed for a particular antennas feed thus requiring time consuming and inconvenient adaptations for use with other antennas. Such polarization devices are also large and bulky as well as being heavy. In addition, they can be produced only at high costs.

Other major problems include phase and amplitude inbalance occurring when employing coaxial cables and connectors for interconnecting the hardware. Often an additional coaxial phase shifter is required.

SUMMARY OF THE INVENTION

The present invention provides a microwave isolation switch comprising a D.C. bias source and a diode network for passing a microwave signal from an input port to an output port when the D.C. bias source is in a negative mode of operation and for reflecting and terminating the microwave signal when the D.C. bias source is in a positive mode of operation.

Accordingly, one object of the present invention is to provide greater adaptability.

Another object of the present invention is to reduce size and weight.

Still another object of the present invention is to lower production costs.

A still further object of the present invention is to provide a small inexpensive and reliable microwave isolation switch.

Other objects and a more complete appreciation of the present invention and its many attendant advantages will develop as the same becomes better understood by reference to the following detailed description when considered in connection with the accompanying drawings in which like reference numerals designate like parts throughout the figures thereof and wherein.

BRIEF DESCRIPTION OF THE PREFERRED EMBODIMENT

Figure 1:
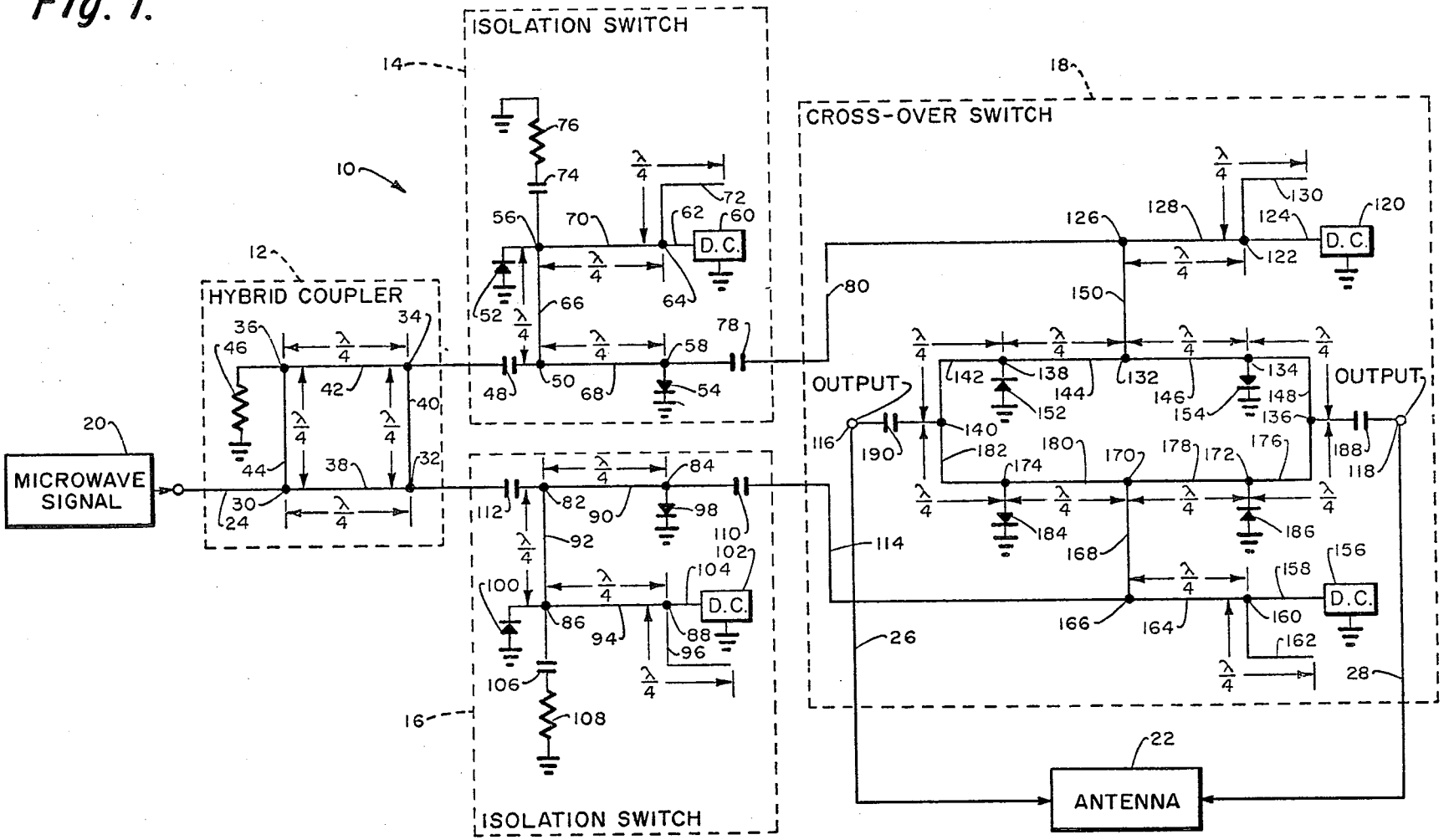
FIG. 1 illustrates one embodiment of the present invention.

Turning to the FIGURE, a multiple polarization switch 10 for narrow band operation is illustrated comprising hybrid coupler 12, isolation switch 14, isolation switch 16 and cross-over switch 18. A microwave signal source 20 of substantially discrete frequency is illustrated in FIG. 1 to provide multiple polarization switch 10 with a microwave signal source or input. Quadrature feed antenna 22 is illustrated to show where the outputs from multiple polarization switch 10 go. Microwave signal source 20 inputs multiple polarization switch 10 on line 24. Multiple polarization switch 10 has outputs on line 26 and line 28 inputting quadrature feed antenna 22.

Hybird coupler 12 comprises a square shaped strip transmission line having corners 30, 32, 34 and 36. Strip transmission line 38, disposed between corners 30 and 32, is fabricated from 35 ohm impedance material as is strip transmission line 42 disposed between corners 34 and 36. Strip transmission line 40, disposed between corners 32 and 34, is fabricated from 50 ohm impedance material as is strip transmission line 44 disposed between corners 30 and 36. It is noted that the impedances specified for strip transmission lines throughout this application are specified with respect to the frequency of the signal from microwave source 20. Strip transmission lines 40, 42, 44 and 38 are each one-quarter of the wavelength of the microwave signal from microwave signal source 20 in length. 50 ohm resistor 46 is connected between corner 36 and a reference potential, in this case ground. 50 ohm resistor 46 provides output isolation. The microwave signal source 20 is coupled to corner 30 via line 24. The difference in impedance between lines 38 and 42 and 40 and 44 produce at corners 34 and 32 a pair of signals substantially 90° out of phase with each other but of the same frequency.

The signal at corner 34 is coupled to isolation switch 14 thru D.C. blocking capacitor 48 to switch port 50. Isolation switch 14 includes diode 52 and diode 54 connected respectively to switch ports 56 and 58. D.C. bias source 60 outputs either a negative D.C. current or a positive D.C. current on line 62 to bias port 64.

Strip transmission line 66 disposed between switch ports 50 and 56 is fabricated from 50 ohm impedance material and is one-quarter of the wavelength of the microwave signal from hybrid coupler 12 in length as is strip transmission line 68 disposed between switch port 50 and switch port 58.

Strip transmission line 70 disposed between switch port 56 and bias port 64 is fabricated from 100 ohm to 120 ohm impedance material. Strip transmission line 70 is one-quarter of the wavelength of the signal from hybrid coupler 12 in length. Strip transmission line 70 serves the purpose of isolating D.C. bias source 60 from the microwave signal from hybrid coupler 12.

Strip transmission line 72 is fabricated from fifty ohm impedance material that is connected at one end to bias port 64 and is open at the other end. Strip transmission line 72 serves as a short to the microwave signal from hybrid coupler 12.

D.C. blocking capacitor 74 and fifty ohm resistor 76 are connected in series between switch port 56 and a reference potential. The output of isolation switch 14 from switch port 58 is coupled through D.C. blocking capacitor 78 to line 80 of cross-over switch 18.

The operation of isolation switch 14 is as follows.

When D.C. bias source 60 is in the positive mode or is outputting a positive D.C. current, diode 52 is an open circuit and diode 54 is a short circuit to the microwave signal from hybrid coupler 12. Shorted diode 54 causes the power from the microwave signal inputting isolation switch 14 at port 50 to be reflected and terminated in fifty ohm resistor 76. Thus, when D.C. bias source 60 is in the positive mode, the microwave signal is not outputted on line 80 to cross-over switch 18. When D.C. bias source 60 is in the negative mode or is outputting the negative D.C. current, diode 52 is a short circuit to ground and diode 54 is an open circuit to ground thereby allowing the microwave signal inputting isolation switch 14 at port 50 to appear on line 80 of cross-over switch 18. D.C. decoupling capacitors or blocking capacitors 48, 74 and 78 prevent the D.C. current from D.C. bias source 60 from interferring with the operation hybrid coupler 12 or cross-over switch 18.

Isolation switch 16 is identical in operation and structure to isolation switch 14. The signal at corner 32 is coupled to isolation switch 16 through D.C. blocking capacitor 112 to switch port 82. Isolation switch 16 includes diodes 100 and 98 connected respectively to switch ports 86 and 84. D.C. bias source 102 outputs either a negative D.C. current or a positive D.C. current on line 104 to bias port 88.

Strip transmission line 92 disposed between switch ports 82 and 86 is fabricated from 50 ohm impedance material and is one-quarter of the wavelength of the microwave signal from hybrid coupler 12 in length as is strip transmission line 90 disposed between switch port 82 and 84.

Strip transmission line 94 disposed between switch port 86 and bias port 88 is fabricated from one-hundred ohm to one-hundred twenty ohm impedance material. Strip transmission line 94 is one-quarter of the wavelength of the signal from hybrid coupler 12 in length. Strip transmission line 94 serves the purpose of isolating D.C. bias source 102 from the microwave signal from hybrid coupler 12.

Strip transmission line 96 is fabricated from fifty ohm impedance material that is connected at one end to bias port 88 and is open at the other end. Strip transmission line 96 serves as a short to the microwave signal from hybrid coupler 12.

D.C. blocking capacitor 106 and 50 ohm resistor 108 are connected in series between switch port 86 and a reference potential. The output of isolation switch 16 from switch port 84 is coupled through D.C. blocking capacitor 110 to line 114 of cross-over switch 18.

The operation of isolation switch 16 is as follows. When D.C. bias source 102 is in the positive mode or is outputting a positive D.C. current, diode 100 is an open circuit and diode 98 is a short circuit to the microwave signal from hybrid coupler 12. Shorted diode 98 causes the power from the microwave signal inputting isolation switch 16 at port 82 to be reflected and terminated in 50 ohm resistor 108. Thus, when D.C. bias source 102 is in the positive mode, the microwave signal is not outputted on line 114 to cross-over switch 18. When D.C. bias source 102 is in the negative mode or is outputting the negative D.C. current, diode 100 is a short circuit to ground and diode 98 is an open circuit to ground thereby allowing the microwave signal inputting isolation switch 16 at port 82 to appear on line 114 of cross-over switch 18. D.C. decoupling capacitors or blocking capacitors 112, 106, and 110 prevent the D.C. current from D.C. bias source 102 from interferring with the operation of hybrid coupler 12 or cross-over switch 18.

Cross-over switch 18 is inputted by isolation switch 14 via line 80 and by isolation switch 16 via line 114. Depending upon the operation desired, the signal on line 80 is 90° out of phase but of the same frequency as the signal on line 114 or there is no signal on line 80 and the signal on line 114 is 90° out of phase with the signal entering isolation switch 14 at switch port 50 or there is no signal on line 114 and a signal on line 80 is 90° out of phase with the signal entering isolation switch 16 at switch port 82. Cross-over switch 18 connects the signal on line 80 to output port 118 and the signal on line 114 to output port 116 or connects the signal on line 80 to output port 116 and the signal on line 114 to output port 118.

D.C. bias source 120 is connected to bias port 122 via line 124. Strip transmission line, 128 disposed between bias port 122 and switch port 126, is fabricated of 100 to 120 ohm impedance material and is one-quarter of the wavelength of the signal of line 80 in length. Strip transmission line 128 serves to isolate D.C. bias source 120 from the microwave signal on line 80.

Strip transmission line 130 connected at one end to bias port 122 and open at the other end is fabricated of 50 ohm impedance material and is one-quarter of the wavelength of the signal on line 80 in length. Strip transmission line 130 serves as a short to the microwave signal appearing on line 80.

Switch port 126 is connected to switch port 132 via line 150. Strip transmission lines 142, 144, 146 and 148 disposed respectively between ports 140 and 138, 138 and 132, 132 and 134, 134 and 136 are fabricated from 50 ohm impedance material and are each one-quarter of the wavelength of the signal on line 80 in length. Diode 152 is connected between switch port 138 and a reference potential. Diode 154 is connected between switch port 134 and a reference potential.

Strip transmission lines 182, 180, 178, and 176 are connected respectively between switch ports 140 and 174, 174 and 170, 170 and 172, 172 and 136. Strip transmission lines 182, 180, 178, and 176 are fabricated from 50 ohm impedance material and are one-quarter of the wavelength of the signal inputting cross-over switch 18 on line 114 in length. Diode 184 is connected between switch port 174 and a reference potential. Didoe 186 is connected between switch port 172 and a reference potential. Switch port 170 is connected to switch port 166 via line 168. D.C. bias source 156 is connected to bias port 160 via line 158.

Strip transmission line 164 is connected between switch port 166 and bias port 160. Strip transmission line 164 is fabricated from one-hundred to one-hundred twenty ohm impedance material and is one-quarter of the wavelength of the signal on line 114 in length. Strip transmission line 162 is connected to bias port 160 at one end and is open at the other end. Strip transmission line 162 is fabricated from 50 ohm impedance material and is one-quarter of the wavelength of the signal on line 114 in length. Capacitors 188 and 190 serve to block the D.C. current from D.C. bias sources 120 and 156 from outputs 116 and 118.

The operation of cross-over switch 18 is as follows. D.C. bias source 120 has a positive mode and a negative mode. When D.C. bias source 120 is in the positive mode or outputting a positive current diode 154 is a short circuit to ground for the signal on line 80 while diode 152 is an open circuit to ground for the signal on line 80. Thus, the signal on line 80 traverses a path to output 116 whenever D.C. bias source 120 is in the positive mode. When D.C. bias source 120 is in negative mode or outputting a negative current diode 152 is a short circuit to ground for the signal on line 80 while diode 154 is an open circuit to ground for the signal on line 80. Thus, the signal on line 80 is directed to appear on output 118 when D.C. bias source 120 is in the negative mode.

Similarly, when D.C. bias source 156 is in the negative mode or outputting a negative current, diode 184 is reverse biased or a open circuit to ground for the signal on line 114 while diode 186 is forward biased or a short to ground for the signal on line 114. Thus, when D.C. bias source 156 is in the negative mode the signal on line 114 is directed to appear on output 116. When D.C. bias source 156 is in the positive mode or outputting a positive current, diode 184 is forward biased for a short to ground for the signal on line 114 while diode 186 is reverse biased or an open to ground for the signal on line 114. Thus, when D.C. bias source 156 is in the positive mode the signal on line 114 is directed to appear on output 118.

It is noted that multiple polarization switch 10 has four modes. Mode number 1 is right-hand circular polarization mode where a signal of amplitude A at 0° phase appears on line 116 while a signal of amplitude A at 90° phase appears on line 118. The second mode is left-hand circular polarization mode where a signal of amplitude A at 90° phase appears on line 116 while a signal of amplitude A at 0° phase appears on output 118. The third mode is the horizontal polarization mode where a signal of amplitude A at 0° phase appears on output 116 while no signal appears on output 118. The fourth mode is the vertical polarization mode where no signal appears on output 116 while a signal of amplitude A at 0° phase appears on output 118. Of course D.C. bias sources 60, 102, 120 and 156 are preset to achieve the desired mode.

Prior art multiple polarization switches are built using discrete coaxial microwave components such as relays, hybrid couplers and cables. Major problems in phase and amplitude balance occur when using coaxial cables and connectors for interconnecting the hardware and additive coaxial phase shifter is required. It is noted that multiple polarization switch 10 is designed completely with strip line components and techniques. Thus, multiple polarization switch 10 can utilize printed circuit layout techniques which exhibit symmetry in the branches to insure amplitude and phase balance.

It is noted that diodes 52, 100, 152, 154, 184, and 186 are PIN diodes but that other suitable switching elements may be utilized.

It is noted that by changing the impedances of strip transmission lines 40, 42, 44 and 38 of hybrid coupler 12 a variety of different phase shifts and amplitudes can be realized at ports 32 and 34. It is noted that multiple polarization switch 10 can be of the narrow band design with a plus or minus five percent band width around the frequency of the signal of microwave signal source 20.

It is noted that the bias port redundancy in cross-over switch 18 is incorporated to lend balance to cross-over switch 18.

It is noted that all of the lines upon which the signal flows in multiple polarization switch 10 of FIG. 1 are of strip transmission line material which lends itself to printed circuit designs. All of the strip line transmission line material not so designated above is fabricated of fifty ohm impedance material. There are a multiplicity of strip line materials availavle for use with printed circuit boards. The widths of these materials will vary for the impedance required in the transmission lines. Some representative materials include teflon, fibreglass, polystyrene, polyolfen, duroid and ceramic band materials as well as others too numerous to mention.

It is noted that resistors 46, 76 and 108 are precision microwave resistors having a 50 ohm impedance. In the printed circuit design for multiple polarization switch 10 of FIG. 1 all corners and junctions are mitred for optimum matching.

Obviously numerous modifications and variations of the present invention are possible in light of the above teachings. It is therefore to be understood that within the scope of the appended claims, the invention may be practiced otherwise than as specifically described herein.

What is claimed is:

1. A microwave isolation switch for a microwave signal comprising:
   a. an input port connected to receive a microwave signal;
   b. an output port;
   c. a D.C. bias source having a positive mode of operation when generating a positive current, a negative mode of operation when generating a negative current, and a bias port;
   d. a first switch port connected to said input port;
   e. a second switch port connected to said output port;
   f. a third switch port connected to said bias port;
   g. a substantially fifty ohm resistor connected between said third switch port and a reference potential;
   h. first means for electrically interconnecting said first and second switch ports;
   i. second means for electrically interconnecting said first and third switch ports;
   j. first switch means connected between said third switch port and a reference potential, said first switch means being a short to said microwave signal when said D.C. bias source is in the negative mode, said first switch means being an open to said microwave signal when said D.C. bias source is in the positive mode;
   k. second switch means connected between said second switch port and a reference potential, said second switch means being a short to said microwave signal when said D.C. bias source is in the positive mode, said second switch means being an open to said microwave signal when said D.C. bias source is in the negative mode;
   l. when said D.C. bias source is in the positive mode said second switch means causes said microwave signal to be reflected and terminated in said fifty ohm resistor, when said D.C. bias source is in the negative mode said microwave signal is passed to said output port.

2. The apparatus of claim 1 further including:
   a. means for electrically isolating said D.C. bias source from said microwave signal, said isolating means being connected between said bias port and said third switch port;
   b. means connected to said D.C. bias port for shorting said microwave signal.

3. The apparatus of claim 2 wherein said isolating means includes a strip transmission line of substantially 100 ohm material being one-quarter of the wavelength of said microwave signal in length.

4. The apparatus of claim 2 wherein said shorting means includes a strip transmission line of substantially 50 ohm material being one-quarter of the wavelength of said microwave signal in length.

5. The apparatus of claim 1 wherein said first interconnecting means includes a strip transmission line of substantially 50 ohm material being one-quarter of the wavelength of said microwave signal in length.

6. The apparatus of Claim 1 wherein said second interconnection means includes a strip transmission line of substantially 50 ohm material being one quarter of the wavelength of said microwave signal in length.

7. The apparatus of claim 1 wherein said first switch means includes a diode.

8. The apparatus of claim 1 wherein said second switch means includes a diode.

9. The apparatus of claim 1 further comprising means connected between said third switch port and said resistor for decoupling direct current signals from said resistor.

10. The apparatus of claim 1 further comprising:
   a. means connected between said second switch port and said output port for decoupling direct current signals from said output port;
   b. means connected between said first switch port and said input port for decoupling direct current signals from said input port.

* * * * *